US009296030B2

(12) United States Patent
Stranz et al.

(10) Patent No.: US 9,296,030 B2
(45) Date of Patent: Mar. 29, 2016

(54) METHOD AND DEVICE FOR EXPLOSIVE FORMING

(71) Applicants: Andreas Stranz, Reichenau (AT); Alexander Zak, Troy, MI (US)

(72) Inventors: Andreas Stranz, Reichenau (AT); Alexander Zak, Troy, MI (US)

(73) Assignee: Cosma Engineering Europe AG, Oberwaltersdorf (AT)

( * ) Notice: Subject to any disclaimer, the term of this patent is extended or adjusted under 35 U.S.C. 154(b) by 11 days.

(21) Appl. No.: 14/153,855

(22) Filed: Jan. 13, 2014

(65) Prior Publication Data

US 2014/0318203 A1 Oct. 30, 2014

Related U.S. Application Data

(62) Division of application No. 12/377,198, filed as application No. PCT/EP2007/006937 on Aug. 6, 2007, now Pat. No. 8,650,921.

(30) Foreign Application Priority Data

Aug. 11, 2006 (DE) ..... 10 2006 037 754

(51) Int. Cl.

| | |
|---|---|
| ***B21D 26/08*** | (2006.01) |
| ***F42D 3/00*** | (2006.01) |
| ***B21D 37/16*** | (2006.01) |

(52) U.S. Cl.

CPC ..... *B21D 26/08* (2013.01); *B21D 37/16* (2013.01); *F42D 3/00* (2013.01); *Y10T 29/49806* (2015.01)

(58) Field of Classification Search

CPC ..... B22D 27/045; B22D 7/005; B21D 26/08; B21D 26/14

USPC ..... 72/54–63, 430, 706, 342.3, 342.4; 29/421.1, 421.2; 105/209; 89/6, 6.5

See application file for complete search history.

(56) References Cited

U.S. PATENT DOCUMENTS

| | | | | |
|---|---|---|---|---|
| 3,195,334 | A * | 7/1965 | Filler | 72/56 |
| 3,342,048 | A | 9/1967 | Johnson et al. | |
| 3,809,964 | A * | 5/1974 | Ceyrat | 102/202.14 |
| 3,820,222 | A * | 6/1974 | Lieberman | 29/890.031 |
| 4,687,049 | A * | 8/1987 | Golben | 165/104.12 |
| 5,220,727 | A * | 6/1993 | Hochstein | 29/888.1 |
| 6,222,445 | B1 * | 4/2001 | Beckhusen | 340/457 |
| 6,884,976 | B2 * | 4/2005 | Matsen et al. | 219/634 |

FOREIGN PATENT DOCUMENTS

| | | | |
|---|---|---|---|
| EP | 0830907 | A2 | 3/1998 |
| GB | 1362923 | A * | 8/1974 |

* cited by examiner

*Primary Examiner* — Kevin P Kerns
*Assistant Examiner* — Steven Ha
(74) *Attorney, Agent, or Firm* — Dickinson Wright PLLC

(57) ABSTRACT

With the invention, a method and device for explosive forming of work pieces, in which at least one work piece is arranged in at least one die and deformed by means of an explosive to be ignited, is to be improved, in that an ignition mechanism that is technically simple to handle, is produced with the shortest possible setup time, which permits the most precise possible ignition of the explosive with time-repeatable accuracy. This task is solved by a method and device, in which at least one work piece is arranged in at least one die and deformed by means of an explosive to be ignited, in which the explosive is ignited by means of induction.

13 Claims, 5 Drawing Sheets

METHOD AND DEVICE FOR EXPLOSIVE FORMING

CROSS-REFERENCE TO RELATED APPLICATIONS

This U.S. Divisional Patent Application claims priority to U.S. patent application Ser. No. 12/377,198 filed Feb. 11, 2009 entitled "Method And Device For Explosive Forming" which claims priority to PCT/EP2007/06937 filed Aug. 6, 2007 which claims priority from German Patent No. 10 2006 037 754 filed on Aug. 11, 2006, entitled "Verfahren und Vorrichtung zum Explosionsumformen" (Method and Device for Explosive Forming), the disclosures of which are incorporated herein by reference for all purposes.

FIELD OF THE INVENTION

The invention concerns a method and a device for explosive forming.

BACKGROUND OF THE INVENTION

During explosive forming, a work piece is arranged in a die and deformed by igniting an explosive, for example, a gas mixture, in the die. The explosive is generally introduced to the die, and also ignited here. Two problems are then posed. On the one hand, the die or ignition mechanism must be suitable for initiating the explosion in targeted fashion and withstanding the high loads that occur during the explosion and, on the other hand, good forming results in the shortest possible setup time must be achieved repeatedly.

In a method known from EP 0 830 907 for forming of hollow elements, like cans, a hollow element is inserted into a die and the upper opening of the hollow element closed with a plug. An explosive gas is introduced to the cavity via a line in the plug, which is then ignited via a spark plug arranged in the plug.

In a method described in U.S. Pat. No. 3,342,048, a work piece to be deformed is also arranged in the die and filled with an explosive gas mixture. Ignition occurs here by means of mercury fulminate and a heating wire or filament. Both methods are particularly suited for single part production and have not been able to gain acceptance in practice for mass production.

SUMMARY OF THE INVENTION

The underlying task of the invention is to improve a method and device of the generic type just mentioned, so that an ignition mechanism that is technically easy to handle is formed, permitting the most precise possible ignition of the explosive with time-repeatable accuracy, despite short setup times.

This task is solved according to the invention with the method with the features of Claim 1.

By ignition by means of induction, the explosion can be readily controlled in the die. A voltage and the corresponding heat can be induced technically simply and relatively precisely in a desired ignition site. Depending on the flow density, ignition of the explosive can also be controlled in time relatively well and precisely. By varying the flow density, the induced voltage and therefore the forming heat can be adjusted well technically. These factors permit good predictability and reproduction accuracy of the forming result.

In one variant of the invention, an induction element can be cooled at least temporarily. Because of this, heat development in the induction element and therefore the ignition can be controlled more precisely. In addition, overheating of the induction element can be avoided.

Advantageously, cooling can occur between subsequent ignitions. The cooling phase of the induction element can be accelerated on this account. It is therefore ready to be used again more quickly. Cycle times can thus be shortened.

In another embodiment of the invention, the explosive can be ignited at several ignition sites of a die. For example, several detonation fronts can thus be produced within a die. Depending on the site at which the explosive is situated within the die, and the site at which it is ignited, the course of the detonation fronts can then be adjusted to the requirements of the forming process.

The explosive can advantageously be ignited at at least one ignition site of several dies each. Thus, several forming processes can occur simultaneously, increasing the efficiency of the process and the corresponding device.

In one variant of the invention, the explosive can be simultaneously ignited at several ignition sites. If simultaneous ignition occurs at several sites of an individual die, several detonation fronts can be produced within a die. If simultaneous ignition, on the other hand, occurs in several dies, the efficiency of the device can be increased.

In an advantageous embodiment of the invention, the explosive can be ignited at several ignition sites with time offset. If time-offset ignition occurs in an individual die of the device, several detonation fronts can be produced within the die on this account. The time offset then permits adjustment of the time response of the individual detonation fronts within the die. If time offset ignition occurs in different dies of the device, for example, all the dies of the device can be ignited in succession. This helps to shorten the cycle times when the parallel forming processes overlap in time.

In principle, any combinations of simultaneous and time offset ignition are possible in one and/or several dies of the device. The method can be readily adapted to different production requirements. The basic idea of controlling propagation of the detonation fronts via time-variable ignition at one or more sites of the die and thus influencing the forming result would also be attainable independently of the type of ignition, whether with induction or otherwise.

The task is further solved by the features of Claim 8.

By ignition with at least one induction element, the explosion can be controlled in the die, both locally and in time. The induction element is technically easy to implement and permits control of the induced voltage and therefore the produced heat via the flux density. This permits a good forming result with simultaneously good predictability and reproduction accuracy of the results.

In another variant of the invention, the induction element can be arranged in a wall of the die. This permits a compact design and is easy to achieve technically.

Advantageously, the induction element can have at least one ignition device arranged in an explosion chamber of the die, in which a voltage can be induced. The ignition device can be adjusted well to its task, namely, induction and ignition.

In one variant of the invention, the ignition device can contain tungsten and/or copper. Because of this, good inductance of the ignition device and good stability relative to the explosion forces can be achieved.

In an advantageous embodiment of the invention, the ignition device can be arranged extending into the explosion chamber at least in areas. The voltage and the heat required for ignition can thus be directly induced in the explosion chamber.

The ignition device can advantageously be arranged in annular fashion around an explosion chamber of the die. A type of ignition ring can be formed in the explosion chamber.

In another embodiment of the invention, the ignition device can be arranged flush with the wall of the explosion chamber. The ignition device can be integrated well in the die within a space-saving way. By flush arrangement, the explosion forces acting on the ignition device can also be kept low.

Advantageously, the inside diameter of the ignition device can correspond approximately to the inside diameter of the explosion chamber. Thus, the ignition device can be integrated well in the explosion chamber.

In one variant of the invention, the inside diameter of the ignition device can be about 20 to 40 mm, preferably about 25 to 35 mm, and especially about 30 mm. This has proven advantageous, in practice, and guarantees good forming results.

In an advantageous embodiment of the invention, the induction element can have at least one coil arrangement to induce a voltage in an ignition device, which is arranged outside the explosion chamber of the die. The coil is thus readily accessible from the outside and protected from the explosion.

Advantageously, the coil arrangement can be arranged on an area of the ignition finger lying outside the die. This permits simple assembly, for example, by simple pushing of the coil arrangement onto the ignition finger.

In another embodiment of the invention, the coil arrangement can be arranged approximately in annular fashion around an explosion chamber of the die. By radial arrangement of the coil, the voltage and therefore the heat can be directly induced in the explosion chamber.

In one variant of the invention, the induction element can have an insulator that insulates the ignition device relative to the die. The die therefore remains voltage-free.

Advantageously, the induction element can have an insulator that insulates the coil arrangement relative to the die. The die is thus protected from voltage and heat induction.

In an advantageous embodiment of the invention, the induction element can have a cooling device to cool the ignition device and/or the coil arrangement. Because of this, the induction element is protected from overheating. In addition, the cooling times of the induction element can be reduced.

In one variant of the invention, the cooling device can have water as coolant. This is an advantageous and readily available coolant.

The cooling device could advantageously have nitrogen as coolant. This guarantees good cooling performance.

In a further embodiment of the invention, the induction element can be arranged with at least one seal in the die, which seals the explosion space relative to the surroundings. The surroundings can thus be protected from the direct effects of the explosion, like an abrupt pressure and temperature increase, and also from the explosion products, for example, exhaust gases.

The seal advantageously can contain copper. Copper, especially copper-beryllium alloys, have proven to be advantageous in practice, since they offer good sealing properties with simultaneously good stability.

In an advantageous embodiment of the invention, the induction element can contain at least one heating point. The induction heat can thus be concentrated on a point from which the explosion is to proceed. This helps to control the explosion with local precision.

In a variant of the invention, the heating point can extend into the explosion chamber. This layout of the heating point permits a greater heating and ignition surface.

The heating point can advantageously be arranged approximately flush with a wall of the explosion chamber. Loads acting on the heating point during the explosion can thus be kept low.

BRIEF DESCRIPTION OF THE DRAWINGS

Embodiments of the invention are described below with reference to the accompanying drawing. In the drawing.

DETAILED DESCRIPTION OF THE PREFERRED EMBODIMENTS

Figure 1:
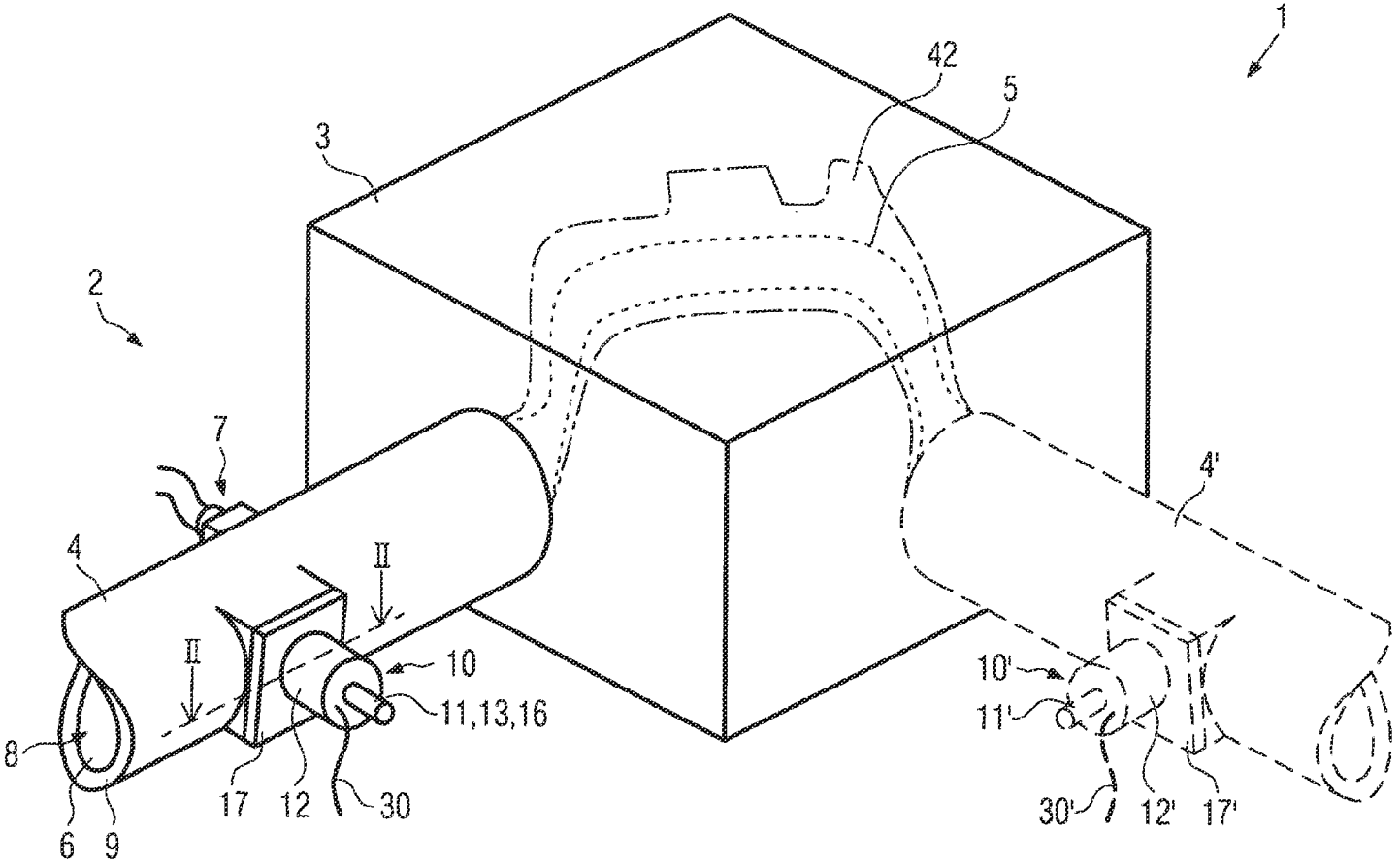
FIG. 1 shows a perspective view of a device for explosive forming according to a first embodiment of the invention.

FIG. 1 shows a perspective view of a device for explosive forming according to a first embodiment of the invention. The device 1 has a multipart die 2 with a forming device 3 and an ignition tube 4. The forming device 3 has a cavity 42 corresponding to the later work piece shape, which is indicated here with a dash-dot line. A work piece 5, indicated by a dotted line, is arranged in cavity 42.

The ignition tube 4 is made from a poorly heat-conducting material or only moderately heat-conducting material, like 1.4301 steel, and has an explosion chamber 6 in its interior. In the assembled state of the multipart die 2 shown here, the explosion chamber 6 is connected to cavity 42 in the forming device 3.

The explosion chamber 6 of the ignition tube 4 can be filled with an explosive 8 via a connection 7. In this embodiment of the invention, the explosive 8 is an explosive gas mixture, namely, oxyhydrogen gas. As an alternative, depending on the application, any different explosives, also fluids or solids, can also be used. The connection 7 is then designed accordingly.

Figure 2:
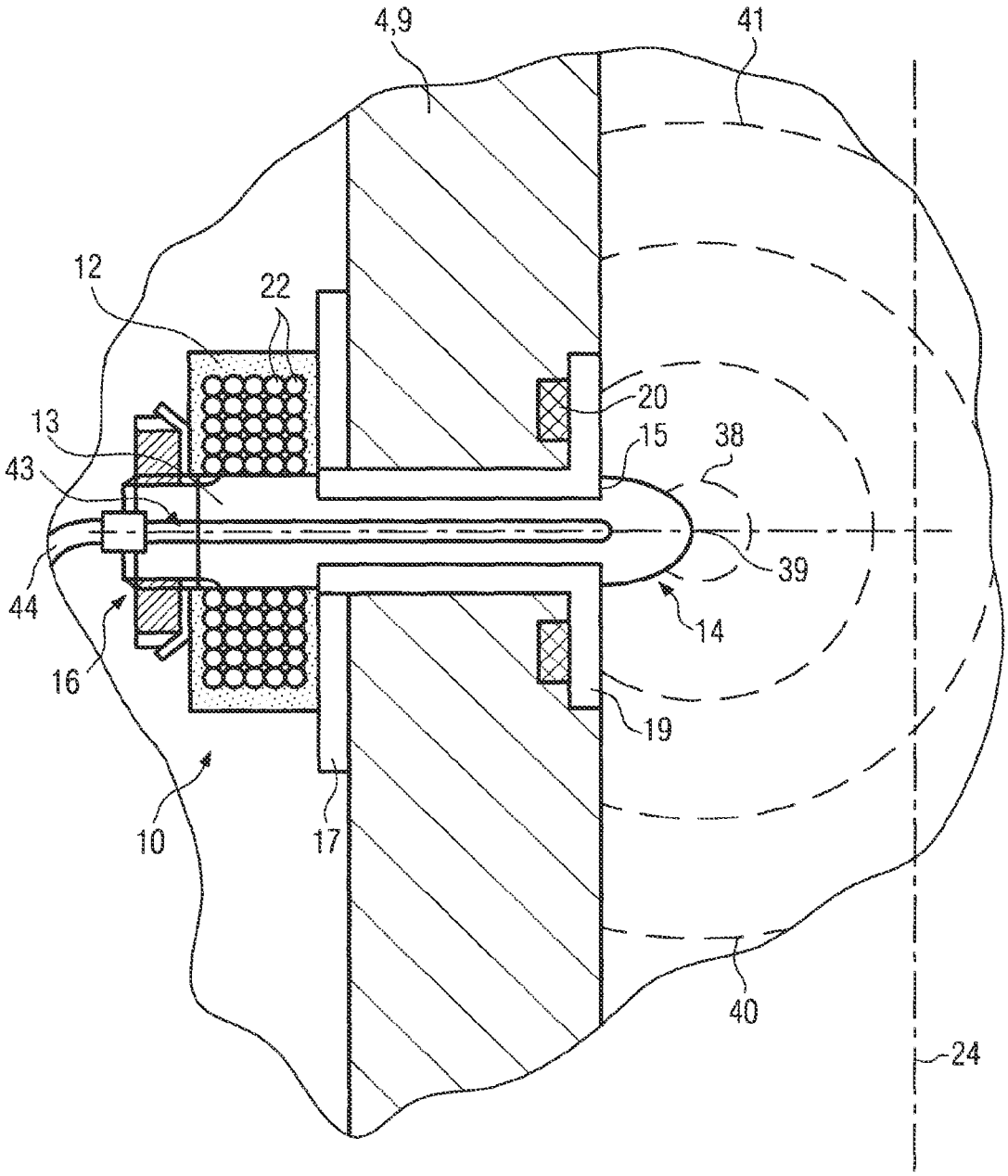
FIG. 2 shows a section II-II through the die of the device from FIG. 1 in the area of the induction element.

An induction element 10 is arranged in the wall 9 of ignition tube 4. This functions as ignition mechanism for explosive 8. It has an ignition device 11 and a coil arrangement 12. In this embodiment of the invention, the ignition device 11 is made from an alloy containing tungsten and copper and designed as an ignition finger 13. It extends through wall 9 of ignition tube 4 into explosion chamber 6. As an alternative, the ignition device 11 can also consist of a material that contains only one of the two elements copper or tungsten. In principle, inductively heatable materials that are preferably hydrogen-resistant and ignition-free are suitable for ignition device 11. The coil arrangement 12 is arranged here outside the die, on the ignition finger 13. FIG. 2 shows the layout of the induction element 10 more precisely.

In this embodiment of the invention, the die 2 has only one ignition tube 4. As an alternative, however, it could also have several ignition tubes, for example, an additional ignition tube 4', as shown here with a dashed line. The additional ignition tube 4' corresponds in design to the first ignition tube 4. However, as an alternative, it could also deviate from this, for example, in which the induction element 10' is arranged on another location of ignition tube 4', or in which the induction element 10' is designed differently, for example, according to FIG. 3. In another embodiment of the invention, several induction elements can also be provided on one ignition tube.

FIG. 2 shows a section II-II through the induction element 10 of device 1 from FIG. 1. The reference numbers used in FIG. 2 denote the same parts as in FIG. 1, so that the description of FIG. 1 is referred to in this respect. The ignition device 11 of induction element 10 is designed approximately bar-like as an ignition finger 13 and is arranged to extend, at least in areas, into explosion space 6. The ignition finger 13 is formed approximately mushroom-shaped on its end 14 facing explosion chamber 6. Ignition finger 13 is arranged shape-mated and/or force-fit in wall 9 via a shoulder 15.

Induction element 10 also has an electric insulator 19, which insulates the ignition finger 13 relative to ignition tube 4 of die 2. In this case, the insulator 19 is arranged between ignition finger 13 and wall 9 and simultaneously formed as a heat insulator.

The coil arrangement 12 in this variant is arranged approximately in annular fashion around an area 16 of ignition finger 13 lying outside of die 2 and wall 9. A voltage can be induced in ignition finger 13 via coil arrangement 12. The field strength of the coil can be adjusted by the number of windings 22.

Between coil arrangement 12 and die 2 and wall 9, the induction element 10 also has an electric insulator 17, which insulates the coil arrangement 12 relative to die 2. This insulator can also simultaneously be designed as a heat insulator. In another embodiment of the invention, the insulators 17, 19 could also be designed in one piece.

The coil arrangement 12 is tightened force-fit against shoulder 15 of ignition finger 13 by means of a nut 18. The induction element is therefore fastened force-fit and/or shape-mated in ignition tube 4.

The induction element 10 is arranged in wall 9 with a seal 20. This seals the explosion chamber 6 in the interior of ignition tube 4 relative to the surroundings. The seal 20 contains copper and is made, in this embodiment, from a copper-beryllium alloy. It is arranged here between insulator 19 and wall 9 and seals this interface gas-tight. The interface between ignition finger 13 and insulator 19 has a press-fit and is also gas-tight.

The induction element 10 in this embodiment of the invention also has a cooling device 43. The cooling device 43 can be supplied a coolant via a cooling line 44. Depending on the application, different coolants, like water or nitrogen, can be used for this purpose. Coolant mixtures or fluids with a coolant additive are also possible.

Figure 3:
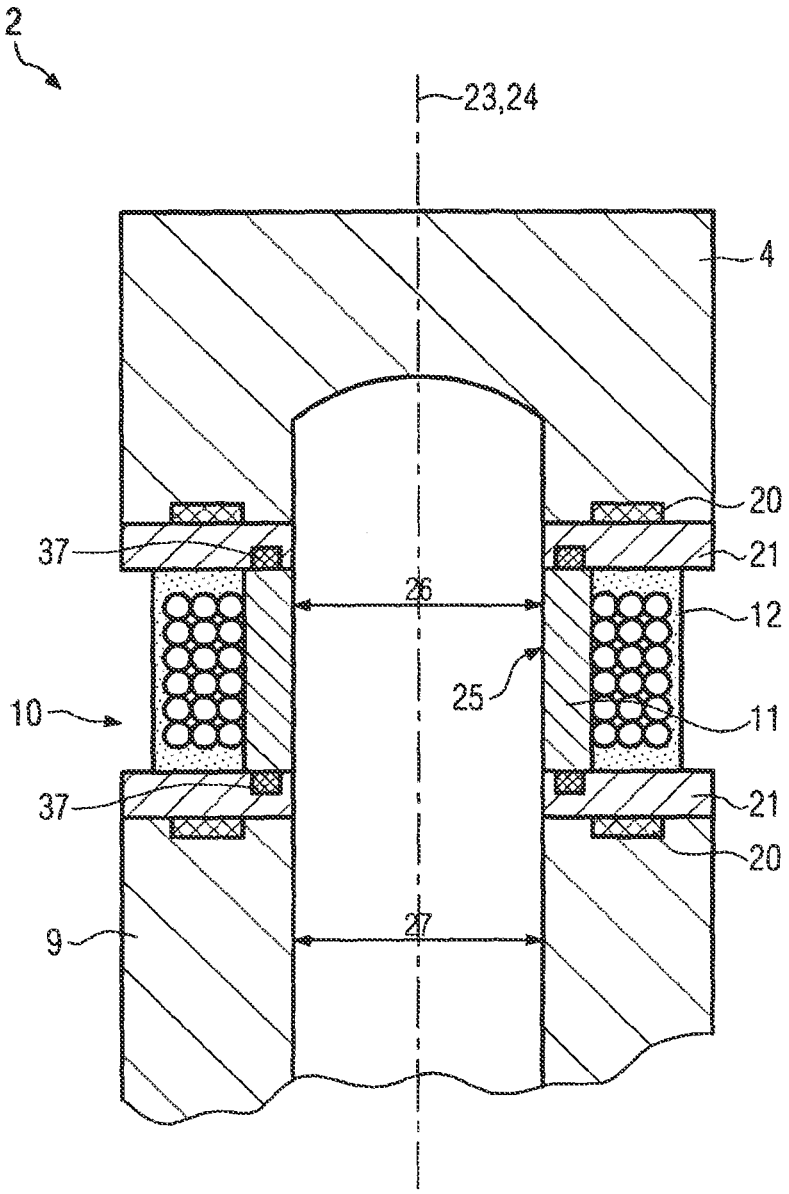
FIG. 3 shows a section through the induction element according to a second embodiment of the invention.

FIG. 3 shows a section through an induction element 10 according to a second embodiment of the invention. The reference numbers used in FIG. 3 refer to the same parts as in FIGS. 1 and 2, so that the description of FIGS. 1 and 2 is referred to in this respect.

The induction element 10 is arranged here approximately in annular fashion around explosion chamber 6. It also has an ignition device 11 in this embodiment, a coil arrangement 12, as well as insulators 21. The induction element 10 is also arranged here with a seal 20 in die 2 and wall 9 of ignition tube 4, which seals the explosion chamber 6 relative to the surroundings.

The ignition device 11 in this embodiment of the invention is designed approximately in the form of a sleeve and arranged in annular fashion around explosion chamber 6. The longitudinal axis 23 of ignition device 11 then coincides approximately with the longitudinal axis 24 of explosion chamber 6.

The internal surface 25 of ignition device 11 facing explosion chamber 6 is approximately flush with wall 9, which limits the explosion chamber 6. This means the inside diameter 26 of ignition device 11 approximately corresponds to the inside diameter 27 of explosion chamber 6. The inside diameter 26 is 30 mm here. This diameter has proven to be advantageous, in practice. As an alternative, the inside diameter 26 can lie in the range from 20 to 40 mm, and especially in the range from 25 to 35 mm. Here again, the ignition device 11 is made from an alloy containing tungsten and/or copper.

The coil arrangement 12 also surrounds the explosion chamber 6 in annular fashion. It is arranged approximately concentric to the explosion chamber 6 and ignition device 11.

The ignition device 11 and the coil arrangement 12 are electrically insulated by means of at least one electric insulator relative to wall 9. In this embodiment of the invention, two insulators 21 are provided. They are each arranged between wall 9 and ignition device 11 and coil arrangement 12. This means the ignition device 11 and the coil arrangement 12 are situated between the two insulators 21.

The interfaces between ignition device 11 and insulators 21 each have a seal 37 that seals the explosion space 6 relative to the surroundings. This seal is also made from a copper-beryllium alloy. As an alternative, other copper-containing materials are considered for this.

The entire induction element 10 is arranged in wall 9 in similar fashion to the first embodiment with a copper-beryllium seal 20, which seals the explosion chamber 6 relative to the surroundings. The seal 20 here is formed in two parts. The sealing parts are provided between an insulator 21 and wall 9.

Figure 4:
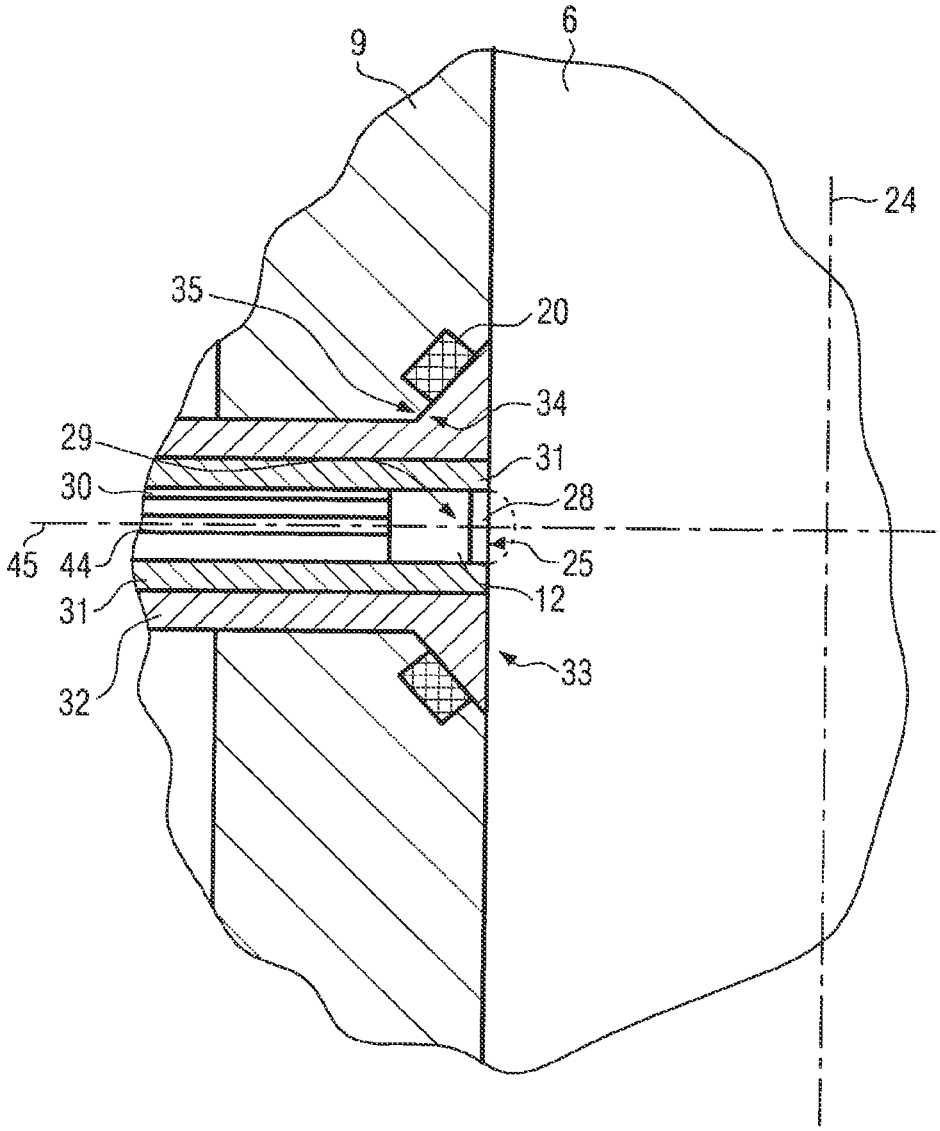
FIG. 4 shows a section through the induction element according to a third embodiment of the invention.

FIG. 4 shows a section through an induction element according to a third embodiment of the invention. The reference numbers used in FIG. 4 refer to the same parts as in FIGS. 1 to 3, so that FIGS. 1 to 3 are referred to in this respect.

The induction element 10 in FIG. 4 is also arranged in wall 9 of ignition tube 4 via a copper-beryllium seal 20. The ignition device 11 is designed here with relatively small dimensions as a heating point 28. The heating point 28 in this embodiment has an approximately round, disk-like shape with relatively small diameter. However, it need not necessarily have this shape. In other embodiments of the invention, the heating point 28 can also be angled, oval or of any other shape.

The inner surface 25 of ignition device 11 and the heating point 28 facing the explosion chamber also runs in this embodiment approximately flush with wall 9. As an alternative, the heating point 28 could also extend, at least on areas, into explosion chamber 6. For example, the inner surface 25 is designed in an arched manner, as indicated by the dotted line.

The coil arrangement 12 is connected after the heating point 28. It is situated on the side 29 of heating point 28 facing away from the explosion chamber 6. In this embodiment of the invention, the coil arrangement 12 is arranged approximately concentric to heating point 28. The coil arrangement 12 is supplied with energy via line 30.

The coil arrangement 12 and the heating point 28 are surrounded by an insulating layer 31 that electrically insulates the heating point 28 and coil arrangement 12 relative to die 2.

In addition, the induction element 10 in this embodiment of the invention has a receiving element 32 arranged in the wall 9 of ignition tube 4. The arrangement described above, of a heating point 28, coil arrangement 12 and insulating layer 31, is arranged in the receiving element 32. The receiving element 32 has at least one conical surface 34 on its end 33 facing explosion chamber 6, which lies against at least one corresponding, conically-shaped surface 35 in wall 9 of ignition tube 4. The conical surface 34 increases the periphery of the receiving element 32 in this area. The interface between the conical surfaces 34, 35 is sealed with the copper-beryllium seal 20, with which the induction element 10 is arranged in wall 9.

The two conical surfaces 34, 35 form a type of conical seat. In one variant of the invention, the receiving element 32 can also function as a valve element. For this purpose, the receiving or valve element 32 is arranged movable in wall 9 along its longitudinal axis 45. By axial movement of receiving element 32 in the direction of explosion chamber 6, a valve, consisting of the two conical surfaces 34, 35, can be opened, among other things. Via this path, for example, the explosive 8 or any other material required for the forming process can be introduced into the explosion chamber 6 and therefore into die 2.

The surface 33 of receiving element 32 facing explosion chamber 6 is arranged approximately flush with wall 9 and the inner surface 25 of heating point 28.

Figure 5:
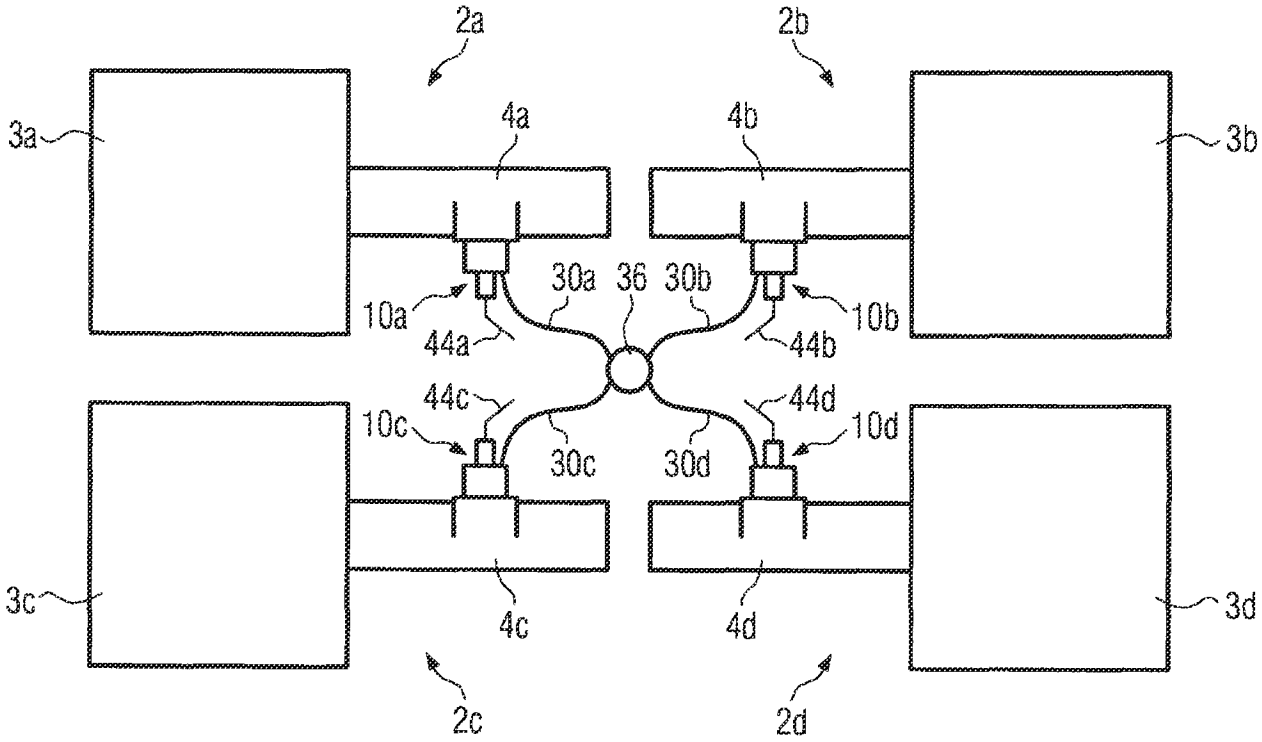
FIG. 5 shows a schematic view of a device with several dies according to a device with several dies according to a fourth embodiment of the invention.

Although the device 1 has been described thus far by means of one die, the device 1 can also have several dies. FIG. 5 shows a schematic view of a device 1 with several dies 2*a* to 2*d*. The reference numbers used in FIG. 5 denote the same parts as in FIGS. 1 to 4, so that the description of FIGS. 1 to 4 is referred to in this respect.

Dies 2*a* to 2*d* of device 1 correspond in their design to the die 2 shown in FIG. 1, and the induction elements 10*a* to 10*d* correspond in their design to the induction element 10 shown in FIG. 2.

FIG. 5 shows a possible arrangement of dies 2*a* to 2*d*. These are positioned here, so that the induction elements 10*a* to 10*d* point to a central area enclosed by dies 2*a* to 2*d*. Lines 30 here are connected to a central power supply 36. Resources, like space, electrical and other connections, etc., that are available can be readily utilized. The indicated cooling lines 44 can also be supplied centrally.

Other variants of the invention can also have a different number of dies in a user-defined arrangement adapted to the corresponding production requirements. In particular, one or more dies can also have several induction devices. The induction devices 10, as shown with the dashed line in FIG. 1, can be arranged on different ignition tubes 4, 4' or on an individual ignition tube 4.

The method of function of the variants depicted in FIGS. 1 to 5 is described below.

The work piece 5 is arranged in the cavity 42 of forming device 3. The die 2 is then brought into the closed state depicted in FIG. 1.

For explosive forming of work piece 5 in die 2, the die 2 is initially filled with explosive 8. This can occur via the connection 7 shown in FIG. 1, through which, in this case, oxyhydrogen gas is introduced to the explosive chamber 6 of ignition tube 4. In other embodiments of the invention, for example, in the third embodiment depicted in FIG. 4, filling of the die 2 with explosive 8 can also occur via induction element 10. For this purpose, the receiving element 32 designed as a valve element is moved in the direction of explosion chamber 6. The conical surface 34 is separated from the conical surface 35 and seal 20 on this account. Through the resulting opening, the explosive 8 can be introduced to explosion chamber 6.

If the die 2 is filled with a predetermined amount of explosive 8, the connection 7 in FIG. 1 is closed and the surfaces 34 and 35 in FIG. 4 are brought into contact and the explosion chamber 6 is closed gas-tight.

To ignite the explosive 8 in explosion chamber 6, a voltage is generated in ignition device 11 via coil arrangement 12. For this purpose, the coil arrangement 12 is supplied with current via electric line 30. The voltage induced in ignition device 11 leads to heating of ignition device 11. When a certain temperature is reached, the explosive 8 or the oxyhydrogen gas ignites in the explosion chamber 6 and explodes.

During explosion of explosive 8, a relatively large pressure change is produced within a short time, which exerts relatively large forces on ignition tube 4 and induction element 10, as well as a relatively large temperature increase. The interface of induction element 10 with ignition tube 4 is also sealed by seal 20 during this abrupt dynamic loading. The interfaces between the individual components of induction element 10 are also sealed gas-tight. The interfaces of ignition device 11 with insulator 19 in FIG. 1, like the interfaces of ignition device 11 and the coil arrangement 12 with insulating layer 31, as well as insulating layer 31 with the receiving element 32 in FIG. 4, are sealed by press-fitting. As an alternative, the individual components can also be connected gas-tight to each other, for example, by thread, gluing, welding or a similar means. The interfaces of the ignition element 2 with insulators 21 in FIG. 2 are sealed by seals 37. This guarantees, on the one hand, good pressure buildup in ignition tube 4, and, on the other hand, protects the surroundings outside of die 2 from the direct effects of the explosion, like pressure and temperature changes, as well as from possible harmful explosion products, like exhaust gases.

By detonation, depending on the design of ignition tube 4 and ignition device 11, one or more detonation fronts 38 are formed. The detonation front 38 propagates, in principle, starting from an ignition site 39, spherically. If ignition occurs point-like in wall 9, as shown in FIGS. 2 and 4, this means that part 40 of the detonation front 38 moves in the direction of work piece 5, starting from ignition site 39. Another part 41 of the detonation front 38, on the other hand, moves away from work piece 5, as shown in FIG. 2. Propagation and the course of the detonation fronts can be determined by the formation and position of the ignition device 11 in the die 2 and ignition tube 4.

If the ignition tube 5 is designed so that the second part 41 of the detonation front 38 is reflected when it reaches the end of ignition tube 4, two detonation fronts 40, 41, for example, can be produced, which move over the work piece 5 with a time offset. Time offsetting of the two detonation fronts 40, 41 can be controlled by the position of ignition device 11 and the shape of ignition tube 4.

If, on the other hand, the die 2 has several induction devices 10 and therefore ignition devices 11, as indicated with the dashed line in FIG. 1, ignition of the explosive 8 can occur at several sites of die 2. For this purpose, all induction elements 10 can be supplied with currents simultaneously or with a time offset. For example, several detonation fronts can be generated within a die 2. In the embodiment depicted in FIG. 1 with the additional ignition tube 4', shown with a dashed line, two detonation fronts can be generated, for example, which move toward one another and meet at a predetermined site in die 2. The forming result can thus be influenced.

Through the explosion, the work piece 5 is pressed into cavity 42 of the forming device 3 of die 2 and deformed. The explosion products, for example, exhaust gases, can then be discharged via connection 7 or via a receiving element 32 designed as a valve element, or via a separate connection from the explosion chamber 6.

Between the individual ignition processes, the induction element 10 can be cooled by cooling device 43. For this purpose, a coolant is passed through cooling line 44 into cooling device 43. Cooling can occur, for example, directly after ignition of the explosive 8. Because of this, the cooling time of the induction device 10 can be shortened and it can be ready for use again more quickly. The time, within which two subsequent ignitions are possible, can thus be shortened.

Depending on the embodiment of the invention, the ignition device 11 and possibly the coil arrangement 12 are then cooled.

What is claimed is:

1. A method for explosive forming comprising:

arranging at least one work piece in at least one die having a wall;

providing an induction element at least partially in the wall of the at least one die wherein said induction element has an ignition device formed from an ignition-free material, an electrical insulator, and wherein said electrical insulator electrically and thermally insulates said ignition device from said wall and a coil arrangement;

inductively heating the ignition device arranged in said wall with the coil arrangement; and deforming the at least one workpiece with the induction element by igniting an explosive by means of induction during said step of inductively heating.

2. The method according to claim 1, further including a step of cooling the induction element at least temporarily, after said step of deforming.

3. The method according to claim 2, wherein said step of cooling occurs between successive ignitions.

4. The method according to claim 1, further including the step of igniting the explosive at a plurality of ignition sites of a die, during said step of deforming.

5. The method according to claim 1, further including the step of igniting the explosive at at least one ignition site of a plurality of dies during said step of deforming.

6. The method according to claim 1, further including the step of igniting the explosive simultaneously at a plurality of ignition sites during said step of deforming.

7. The method according to claim 1, further including the step of igniting the explosive with a time offset at a plurality of ignition sites during said step of deforming.

8. The method according to claim 1, wherein said ignition device is hydrogen-resistant.

9. The method according to claim 1, wherein the induction element includes an insulator.

10. The method according to claim 1, wherein said step of inductively heating includes the step of generating a voltage in the coil arrangement.

11. The method according to claim 10, wherein said step of inductively heating includes a step of heating the ignition device in response to generating a voltage in the coil arrangement.

12. The method according to claim 11, wherein said step of deforming includes the step of reaching a specified temperature in the ignition device to ignite the explosion.

13. The method according to claim 7, wherein said step of igniting the explosive with a time offset includes the step of propagation at least two detonation fronts for deforming the at least one workpiece in said step of deforming.

* * * * *